US008951467B2

(12) United States Patent
Bedinger, III et al.

(10) Patent No.: US 8,951,467 B2
(45) Date of Patent: Feb. 10, 2015

(54) PREVENTING EQUIPMENT FOULING VIA CORROSION REDUCTION

(71) Applicant: ChemTreat, Inc., Glen Allen, VA (US)

(72) Inventors: Robert Wright Bedinger, III, Richmond, VA (US); Benjamin Edward Niemaseck, Chesterfield, VA (US); Mark Jason Puchovich, Henrico, VA (US); John Richardson, Hanover, VA (US)

(73) Assignee: Chemtreat, Inc., Glen Allen, VA (US)

( * ) Notice: Subject to any disclaimer, the term of this patent is extended or adjusted under 35 U.S.C. 154(b) by 49 days.

(21) Appl. No.: 13/841,863

(22) Filed: Mar. 15, 2013

(65) Prior Publication Data

US 2013/0280124 A1 Oct. 24, 2013

Related U.S. Application Data

(60) Provisional application No. 61/613,786, filed on Mar. 21, 2012.

(51) Int. Cl.

| | |
|---|---|
| ***B08B 17/00*** | (2006.01) |
| ***C23F 11/06*** | (2006.01) |
| ***C23F 11/00*** | (2006.01) |
| ***C02F 5/02*** | (2006.01) |
| ***B08B 7/00*** | (2006.01) |

(Continued)

(52) U.S. Cl.

CPC ..... *C23F 11/00* (2013.01); *C10G 75/02* (2013.01); *C10G 75/04* (2013.01); *C23F 11/08* (2013.01)

USPC ..... 422/14; 422/6; 422/7; 422/13; 422/15; 422/16; 422/17; 422/18; 134/6; 134/18; 134/22.14; 134/22.17; 134/22.19; 252/175; 252/388

(58) Field of Classification Search

CPC ..... C02F 1/042; C02F 5/00; C23F 11/11; C23F 15/00; B08B 3/00

USPC ..... 422/6–7, 13–18, 292; 252/175, 388; 134/6, 18, 22.14, 22.17, 22.19

See application file for complete search history.

(56) References Cited

U.S. PATENT DOCUMENTS

| | | | |
|---|---|---|---|
| 5,714,664 | A | 2/1998 | Fearnside et al. |
| 5,965,785 | A | 10/1999 | Braden et al. |

(Continued)

FOREIGN PATENT DOCUMENTS

| | | | |
|---|---|---|---|
| JP | 2010174340 | A1 | 8/2010 |
| JP | 2010229535 | A1 | 10/2010 |

(Continued)

OTHER PUBLICATIONS

International Search Report for Application PCT/US2013/033306, Sep. 2, 2013, 2 pages, The Hague, Netherlands.

(Continued)

*Primary Examiner* — Monzer R Chorbaji
(74) *Attorney, Agent, or Firm* — Oliff PLC

(57) ABSTRACT

An embodiment prevents equipment fouling (deposition of unwanted material) in an oil recovery system via implementing passivation of metallic components. By preventing or at least slowing or inhibiting corrosion of equipment or components via passivation, such as passivating heat exchangers, metallic piping, and the like, an embodiment in turn reduces fouling thereof. Other embodiments are described and claimed.

14 Claims, 1 Drawing Sheet

(51) Int. Cl.

| | |
|---|---|
| ***B08B 9/00*** | (2006.01) |
| ***C10G 75/02*** | (2006.01) |
| ***C10G 75/04*** | (2006.01) |
| ***C23F 11/08*** | (2006.01) |

(56) References Cited

U.S. PATENT DOCUMENTS

| | | | | |
|---|---|---|---|---|
| 2006/0261312 | A1 | 11/2006 | Hall et al. | |
| 2008/0277620 | A1 * | 11/2008 | Kesavan et al. | 252/175 |
| 2010/0108566 | A1 | 5/2010 | Scattergood et al. | |

FOREIGN PATENT DOCUMENTS

| | | | |
|---|---|---|---|
| WO | 9833869 | A1 | 8/1998 |
| WO | 2004044266 | A1 | 5/2004 |
| WO | 2010087253 | A1 | 8/2010 |

OTHER PUBLICATIONS

Jul. 1, 2014 (Date of Receipt) International Preliminary Report on Patentability issued in International Application No. PCT/US2013/033306.

* cited by examiner

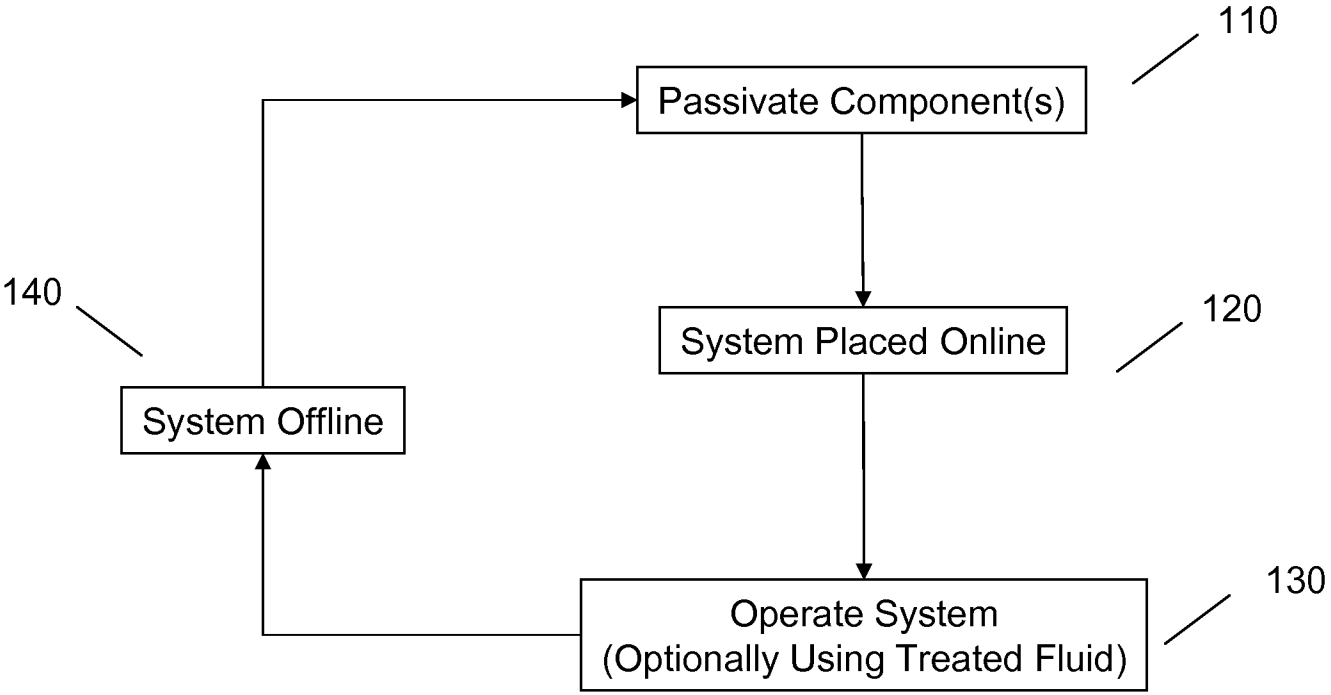
110
Passivate Component(s)
120
System Placed Online
130
Operate System
(Optionally Using Treated Fluid)
140
System Offline

PREVENTING EQUIPMENT FOULING VIA CORROSION REDUCTION

CLAIM FOR PRIORITY

This application claims the benefit of prior U.S. Provisional Patent Application Ser. No. 61/613,786, entitled "PREVENTING EQUIPMENT FOULING VIA CORROSION REDUCTION", filed on Mar. 21, 2012, the contents of which are incorporated by reference in their entirety herein.

BACKGROUND

In an oil recovery system, such as steam-assisted gravity drainage (SAGD), metal components are often exposed to substances that include hydrocarbons and thus cause fouling of the components. As a specific example, in an SAGD process, hot steam is introduced into the ground via a top injection well. The top well descends down to a deep level below the surface (e.g., into oil sands) and then extends horizontally to provide steam to heat oil containing material to a temperature at which it can flow (e.g., down via gravity) to a bottom production well. The oil and steam/water mixture is then pumped from bottom well to the surface where the oil containing mixture may be processed for oil recovery and recycling of the process water.

In processing the oil containing mixture, water is separated from the oil and recycled. The water is recycled partially to minimize environmental impact and partially to conserve resources. The separation process involves the use of metallic heat exchangers to cool the oil containing mixture and separate oil from other process materials. A portion of the water separated from the oil is then recycled (recycled process water).

Components that encounter process water become fouled with a hydrocarbon film that forms on the surface of the components. A common example of such fouling is fouling of a heat exchanger in an SAGD process that is contacted by an oil containing mixture (e.g., SAGD process water) derived from a production well. Conventional practice includes taking the system offline, cleaning the heat exchangers, and thereafter placing the system online. This is time consuming, labor intensive, and expensive.

BRIEF SUMMARY

One embodiment provides a method of preventing hydrocarbon fouling of a metallic component used in an oil recovery system, the method comprising: passivating the metallic component for use in the oil recovery system. The passivating of the metallic component may comprise promoting the formation of a passivating film on the surface of the metallic component to prevent corrosion. The film may be formed via contacting the metallic component with a solution including one or more passivating agents. The one or more passivating agents may be selected from the group consisting of hydroxyethylidene-diphosphonic acid (HEDP), sodium erythorbate, and sodium nitrate. The one or more passivating agents may comprise about 0.1-10% weight HEDP, about 0.1-1.0% weight sodium erythorbate, and about 0.1-10% weight sodium hydroxide.

The method may further comprise: contacting the metallic component with a caustic solution while the oil recovery system is online. The caustic solution may comprise about 50 mg/l sodium hydroxide (NaOH).

The method may further comprise: taking the oil recovery system offline; and contacting the metallic component with a caustic solution following taking the oil recovery system offline. The caustic solution may include NaOH. The caustic solution may include about 50 mg/l sodium hydroxide. The method may further comprise placing the oil recovery system back online.

The oil recovery system may be a steam assisted gravity drainage (SAGD) system and the metallic component may be a heat exchanger.

The passivation of the metallic component may comprise contacting the metallic component with one or more passivating agents selected from the group consisting of sodium borate, stannous salts/Tin, tannic acid, tetra potassium pyrophosphate (TKPP), sodium molybdate, potassium hydroxide, sodium hydroxide, hydroxyethylidene-diphosphonic acid (HEDP), sodium erythorbate, diethylhydroxylamine (DEHA), sodium nitrite, and sodium nitrate. The metallic component may be contacted with the one or more passivating agents while the oil recovery system is online.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

BRIEF DESCRIPTION OF THE SEVERAL VIEWS OF THE DRAWINGS

FIG. 1 illustrates an example method for fouling prevention in an SAGD process.

DETAILED DESCRIPTION

It will be readily understood that the details of the example embodiments, as generally described and illustrated in the figures herein, may be arranged and designed in a wide variety of different ways in addition to the described example embodiments. Thus, the following more detailed description of the example embodiments is not intended to limit the scope of the claims, but is merely representative of certain example embodiments.

Reference throughout this specification to "embodiment (s)" (or the like) means that a particular feature, constituent or agent, step or characteristic described in connection with the embodiment is included in at least one embodiment. Thus, appearances of the phrases "according to embodiments" or "an embodiment" (or the like) in various places throughout this specification are not necessarily all referring to the same example embodiment.

Furthermore, the described features, constituents or agents, steps, or characteristics may be combined in any suitable manner in different embodiments. In the following description, numerous specific details are provided to give a thorough understanding of certain example embodiments. One skilled in the relevant art will recognize, however, that aspects can be practiced without certain specific details, or with other methods, constituents or agents, materials, et cetera. In other instances, well-known structures, materials, constituents, steps or operations are not shown or described in detail to avoid obfuscation.

Components or equipment exposed to/in contact with process water containing hydrocarbons become fouled, i.e., experience formation of a film of hydrocarbon that inhibits the usefulness of the component. For example, the metallic heat exchangers of an SAGD system are fouled with a film of hydrocarbons and other contaminates from the oil containing mixture such as salts, oxides and hydroxides and must therefore be cleaned regularly and/or replaced. The fouling (i.e., hydrocarbon film) cannot be simply removed and results in a need to clean the component, e.g., a heat exchanger, which in turn necessitates taking the system offline.

Conventional attempts to deal with the fouling problem have been ineffective and result in the taking the system offline to clean components, e.g., heat exchangers, on a regular basis. For example, current practice is to clean heat exchangers in an SAGD system approximately every two weeks.

Accordingly, an embodiment prevents equipment fouling using passivation as a treatment prior to contacting metallic components with hydrocarbon containing fluid, i.e., an environment where fouling occurs. For example, an embodiment includes a method of passivating heat exchangers in an SAGD process or system. The treatment may be a treatment to a component prior to its first inclusion in an online system or a treatment following placing the system offline for maintenance. The passivation may further include treatment of the process fluid, e.g., with passivating agents. Fouling includes the formation of unwanted material on the component, e.g., in the form of a film including hydrocarbons that attaches to the equipment or component surface due to the component or equipment coming into contact with process water including hydrocarbons. In one example, fouling includes accumulation of a layer or film of hydrocarbon on the surface of a metallic heat exchanger in an SAGD system.

An embodiment provides passivation via treatment to prevent corrosion. An embodiment therefore prevents fouling via implementing corrosion prevention measures. An embodiment prevents corrosion by passivating low carbon metallic surface(s) used in heat exchangers (and other components such as piping) used in an SAGD system.

The passivation may be applied or accomplished in a variety of ways. For example, an embodiment includes a process of treating metallic equipment surface(s), e.g., via contacting them with a suspension or solution of passivating chemicals or agent(s), prior placing the system online. A passivating agent may be a chemical or combination of chemicals that acts to passivate metal. Additionally or in the alternative, passivation may include one or more applications or techniques that act to passivate, e.g., applying impressed current, cathodic protection, or the like.

Another embodiment includes, in addition to or as an alternative to the treatment, a process of continuously, periodically, or intermittently providing passivation to an ongoing process, e.g., via introduction of passivating agents(s) into the process flow (e.g., into an online SAGD process flow) such that the metallic surface(s) are exposed to passivating treatment and are passivated on a continuous, periodic or intermittent basis.

Another embodiment includes halting the system process, cleaning fouled equipment or components (e.g., via contacting them an appropriate cleaning solution such as a solution of caustic such as about 50 mg/l NaOH (sodium hydroxide), and passivating the metallic equipment or component surface (s) (e.g., via contacting them with a suspension or solution of passivating agent(s)) prior to re-starting the system. Any of the foregoing embodiments may be combined.

Passivation provided by various embodiments prevents, reduces or at least slows or inhibits corrosion of the metallic equipment or component. By preventing, reducing, or at least slowing or inhibiting corrosion of the equipment or component surfaces, such as metallic heat exchangers, metallic piping, and the like, an embodiment in turn reduces equipment fouling. The fouling reduction is a benefit of corrosion reduction because the corrosion on the metallic surface provides an area for fouling substances (e.g., hydrocarbons contained in process water of an SAGD system) to accumulate more rapidly than on non-corroded surfaces.

Therefore, embodiments leverage the realization that reduction in corrosion of equipment or components exposed to process water in turn reduces or eliminates fouling. The reduction of fouling is highly advantageous in various respects, such as reducing system down time and lost productivity due to cleaning and/or replacing fouled equipment. The corrosion prevention afforded by various embodiments is also advantageous aside from preventing fouling, as the corrosion prevention afforded by various embodiments also prevents wear on various system elements, e.g., reduces or slows the formation of holes in metallic piping.

Fouling of such equipment is a problem in many processes. As an example, low-carbon metallic surfaces such as used in piping and heat exchangers of an SAGD system often become fouled due to exposure to hydrocarbon containing process water. The fouling consists of a hydrocarbon film that is formed on the components and is difficult to remove. The fouling inhibits the function of the heat exchangers by reducing heat transfer thereto. Improvements to the SAGD process provided by the various embodiments therefore will give an added benefit of lessening the effects of fouling on the heat exchanger(s) and other equipment involved.

The SAGD process water has a high hydrocarbon content that results in fouling of heat exchange equipment as well as other system components exposed to the process water. This causes a significant loss of heat transfer and cleaning costs. Embodiments address these concerns via passivation techniques, as described herein.

A principle reason for fouling of heat exchangers (and other components) is corrosion of the metallic substrate. This corrosion causes hydrocarbons to accumulate at the surface. The hydrocarbon buildup or fouling then builds on itself, forming a thick heat transfer blocking film. This heat transfer blocking film, among other things, negatively impacts the performance of the heat exchangers.

An embodiment provides for passivation of surfaces subject to fouling during an SAGD process. Passivation in an embodiment leads to the formation of a stable, non-reactive film on the metallic surface, e.g., of the heat exchanger. A surface passivated according to an embodiment is relatively immune to hydrocarbon fouling. Passivation may be achieved chemically through the use of specific treatments, some non-limiting examples of which are included herein. Other chemical treatments, e.g., such as those proposed for cleaning corrosion from metallic surfaces, may be utilized. Alternatively or additionally, other embodiments provide for corrosion prevention by incorporating passivating treatments at various stages of an online process, as further described herein.

An embodiment provides a method for inhibiting the corrosion of metallic surfaces, such as the surfaces of heat exchangers utilized during an SAGD process, to prevent fouling, such as hydrocarbon fouling resultant from contact with SAGD produced water. An example method includes passivation of the metal surface with a treatment of passivating agent(s) including corrosion inhibitor(s) such as phosphate, orthophosphate, phosphonate, borate, zinc, or stannous salts.

An embodiment provides a passivating treatment including anti-corrosion treatment(s). A variety of anti-corrosion treatment(s) may be utilized. For example, rust removal treatments may be utilized. As an example, a passivating treatment may include treatment using one or more passivating agents comprising hydroxyethylidene-diphosphonic acid (HEDP) (from about 0.1-10% weight), sodium erythorbate (from about 0.1-1.0% weight), and sodium hydroxide (from about 0.1-10% weight). These passivating agents may be applied in a first stage, e.g., when the system is offline.

Another example method includes preventing corrosion through the use of passivating treatment(s) including impressed current, cathodic protection or the like, applied to the metallic surfaces as a passivating treatment.

Another example method includes adding a maintenance dose of passivating agent(s) to the process flow such as a corrosion inhibitor to the process water alone or in combination with other treatment, e.g., after component or equipment cleaning. Inclusion of a maintenance dose of corrosion inhibitor(s) provides an added benefit of preventing corrosion in other system components that have not been treated or treated after cleaning, such as piping, even if fouling is not of primary concern.

The following description provides some non-limiting examples (examples 1-6) of constituents or passivating agents that may be included in passivation treatment or ongoing or maintenance treatment. The examples provided correspond to Table 1.

In the examples 1-6, a treated or maintenance/ongoing treated ("treated") metallic surface (metal coupon) was subjected to test conditions. In the examples, treatment included pre-treatment via pre-soaking the metallic surfaces in passivating solution, as indicated. In the examples, maintenance or ongoing treatment was simulated via addition of treatment constituent(s) or agent(s) to the batch suspension of SAGD process water.

The test conditions included a fixed batch of process water obtained from an SAGD operating plant. Treated and untreated metal coupons were suspended in a heated (to about 80 C) solution of the process water from an SAGD operating plant (plus other constituent(s) or agent(s), as indicated in the examples) for a period of about 60 minutes. During suspension, the batch was stirred with a magnetic stirrer to yield flow across the metal coupons.

Example 1

Treatment and Continuous Treatment

A metallic surface (for example, of a metal coupon representative of a metallic heat exchanger) was pre-treated for about 30 minutes at about 25 C in a suspension of about 3000 ppm borax (Sodium Borate, $Na_2B_4O_7$), about 3.3 ppm tin, about 100 ppm tannic acid ($C_{76}H_{52}O_{46}$), about 60 ppm TKPP (tetra potassium pyrophosphate ($K_4P_2O_7$)), about 105 ppm NaMoly (sodium molybdate ($Na_2MoO_4$)), about 990 ppm KOH, about 100 ppm NaTTA (sodium methylbenzotriazole ($C_7H_7N_3$)), and about 336 ppm HEDP (hydroxyethylidene-diphosphonic acid ($C_2H_8O_7P_2$)) in aqueous solution. About 50 ppm NaOH and 60 ppm TKPP were included in process water as continuous treatment.

Example 2

Treatment

A metallic surface (for example, of a metal coupon representative of a metallic heat exchanger) was pre-treated for about 30 minutes at about 25 C in a suspension of about 3000 ppm borax (sodium borate), about 1100 ppm NaOH, about 3.7 ppm tin, and about 100 ppm tannic acid, in aqueous solution.

Example 3

Treatment and Continuous Treatment

A metallic surface (for example, of a metal coupon representative of a metallic heat exchanger) was pre-treated for about 30 minutes at about 25 C in a suspension of about 3000 ppm borax (sodium borate), about 1100 ppm NaOH, about 3.7 ppm tin, and about 100 ppm tannic acid, in aqueous solution. About 60 ppm TKPP and about 50 ppm NaOH were included in process water as continuous treatment.

Example 4

Treatment and Continuous Treatment

A metallic surface (for example, of a metal coupon representative of a metallic heat exchanger) was pre-treated over night (for about 15 hours) at about 25 C in a suspension of about 3000 ppm borax (sodium borate), about 1100 ppm NaOH, about 3.7 ppm tin, and about 100 ppm tannic acid, in aqueous solution. About 60 ppm TKPP and about 50 ppm NaOH were included in process water as continuous treatment and the metallic surface was left in treated process water for about 7 hours of testing.

Example 5

Treatment and Continuous Treatment

A metallic surface (for example, of a metal coupon representative of a metallic heat exchanger) was pre-treated for about 30 minutes at about 25 C in a suspension of about 3000 ppm borax (sodium borate), about 1100 ppm NaOH, and about 100 ppm tannic acid, in aqueous solution. About 60 ppm TKPP and about 50 ppm NaOH were included in process water as continuous treatment.

Example 6

A metallic surface (for example, of a metal coupon representative of a metallic heat exchanger) was pre-treated for about 30 minutes at about 25 C in a suspension of about 2365 ppm KOH, about 600 ppm erythorbic acid ((5R)-5-[(1R)-1,2-dihydroxyethyl]-3,4-dihydroxyfuran-2(5H)-one), about 3600 ppm (hydroxyethylidenediphosphonic acid) (HEDP) ($C_2H_8O_7P_2$), in aqueous solution. About 50 ppm NaOH was included in process water as continuous treatment.

The result of such treatments (as outlined in the examples 1-6 given herein) and testing was no visible corrosion on the treated metallic surface of the metal coupon, with only slight fouling on the edges thereof. By way of example comparison, untreated metallic surfaces (metal coupons) that were subjected to the same testing conditions exhibited significant fouling in the form of dark/blackened deposits on the metal coupons' surfaces. Investigation of the untreated metallic coupon surfaces revealed that the surfaces were corroded and that the corrosion of the surface was directly correlated with the fouling observed in untreated samples.

Throughout the examples given herein, it will be readily understood by those having ordinary skill in the art that any of the treatments outlined herein may be utilized as treatments applied to fouled equipment following cleaning thereof. The cleaning may be a conventional cleaning process. One example cleaning process is cleaning with a caustic cleaning solution including about 50 gm/l NaOH.

TABLE 1

Pretreatment ("x-") and In-Process Treatment ("o-"). All values in ppm.

| | Example 1 | Example 2 | Examples 3-4 | Example 5 | Example 6 |
|---|---|---|---|---|---|
| Borax | x-3000 | x-3000 | x-3000 | x-3000 | |
| NaOH | o-50 | x-1100 | x-1100<br>o-50 | x-1100<br>o-50 | o-50 |
| Tin | x-3.3 | x-3.7 | x-3.7 | | |
| Tannic | x-100 | x-100 | x-100 | x-100 | |
| TKPP | x-60<br>o-60 | | o-60 | o-60 | |
| NaMoly | x-105 | | | | |
| KOH | x-990 | | | | x-2365 |
| NaTTA | x-100 | | | | |
| Ery-thorbic | | | | | x-600 |
| HEDP | x-336 | | | | x-3600 |
| AA/AMPS | | | | | x-900 |

Some pertinent details regarding examples 1-6 are included in Table 1 for convenient reference. All numerical values of Table 1 are in ppm (in aqueous solution, e.g., tap water (treatment) or recycled process water (test or batch suspension)) and "x-" indicates a quantity used in treatment (e.g., in tap water), whereas "o-" indicates a quantity utilized in continuous/process treatment (e.g., in recycled process water of the test or batch suspension).

While examples 1-6 provide non-limiting examples of passivation treatment and/or continuous, periodic or intermittent treatments ("ongoing" treatments) that may be utilized to prevent, reduce or at least slow or inhibit corrosion and thus fouling, other approaches may be undertaken. Thus, for example, a passivating agent including a conventional corrosion prevention agent or agents may be utilized in lieu of or in combination with the example passivating agents of examples 1-6 to reduce corrosion in a SAGD processing system or like system where components or equipment are exposed to or come in contact with hydrocarbon containing process water, and thereby reduce fouling, particularly in heat exchange elements and metallic piping.

In this regard, a passivating solution may include one or more corrosion inhibitors. The passivating solution may include agents selected from the group of sodium borate, stannous salts (Tin), tannic acid, TKPP, sodium molybdate, potassium hydroxide, sodium hydroxide, HEDP, sodium erythorbate, diethylhydroxylamine (DEHA), sodium nitrite, and sodium nitrate. Example amounts for these are indicated in the examples 1-6. For DEHA, an amount from about 0.1-1000 gm/l may be utilized. For sodium nitrite, and amount from about 10-10,000 mg/l may be used. For sodium nitrate, an amount from about 10-10,000 mg/l may be used. An acceptable passivating solution may include one or more agents selected from the group of hydroxyethylidene-diphosphonic acid (HEDP), sodium erythorbate, and sodium hydroxide.

Moreover, other passivating agents or techniques, such as corrosion reduction techniques or treatments, may be used in lieu of or in combination with the example agents of examples 1-6, and/or conventional corrosion prevention agents, to reduce corrosion in a SAGD processing system, and thereby reduce fouling, particularly in heat exchange elements. Examples of such an alternative techniques or applications include but are not necessarily limited to impressed current, cathodic protection, or the like.

In embodiments, passivating agents such as those listed in table 1 and/or other passivating agents may be used in a treatment using aqueous solution or in SAGD process water as the solution to form the treatment suspension or solution. In embodiments, the passivating agents listed in table 1 and/or other passivating agents may be used in the process water as the aqueous solution for maintenance (e.g., continuous) treatment or maintenance dose, i.e., in an online process. In some embodiments, both treatment offline and maintenance treatment online may be utilized or some suitable combination of the foregoing. In some embodiments, the maintenance treatment may be actually continuous (i.e., ongoing), or may be periodic or intermittent in nature.

While the example passivating agents noted above in connection with the examples in some instances involve the use of tannic acid and/or tin, other embodiments may not use these passivating agents. For example, in another example embodiment, a treatment in aqueous solution (for example, under conditions commensurate with those described herein) with borax, NaMoly, KOH, TTA, HEDP, and TKPP, may be used in combination with the following present in the process water as continuous treatment: HEDP, NaOH, propylene glycol monomethyl ether (PGME), and sodium glucoheptonate ($C_7H_{13}NaO_8$).

Embodiments provide corrosion prevention in processes such as SAGD as used in oil recovery. The corrosion prevention provided by embodiments also prevents fouling of metallic surfaces, such as those exposed to hydrocarbon containing fluids in SAGD processes. Embodiments provide various methods to prevent equipment fouling via corrosion reduction.

FIG. 1 illustrates an example method for fouling prevention in an SAGD process. At 110 passivation treatment(s) may be provided to passivate metallic component(s) of the system offline. The passivation treatment(s) may use one or more of the example treatments noted herein alone or in a suitable combination. As outlined in the non-limiting examples above, the metal component(s) in question may be contacted with in or otherwise exposed to the passivation treatment (e.g., tap water or SAGD process water containing passivating agent(s)) at 110 prior to placing the system online.

In step 120, the passivated component(s), such as heat exchange elements having been passivated with one of the non-limiting examples outlined above, are used into the system. For example, passivated heat exchangers are used in a SAGD system for oil recovery processing. The system may then be operated normally at 130 (for example, normal SAGD operation with passivated component(s) contained therein).

Additionally or in the alternative the system may be operated having fluid (e.g., process water) treated continuously or periodically or intermittently, as illustrated in step 130 of FIG. 1. This maintenance treatment may be used alone or in combination with treatment of the component(s).

Additionally or in the alternative, the component(s) may be cleaned, e.g., by taking the system offline at 140, followed by treatment of the component(s) with a passivation treatment, e.g., as outlined in examples 1-6 herein. The cleaned, passivated component(s) may then be re-used in the system for operation. Again, the system fluid (e.g. process water) may be supplemented with maintenance dose(s), e.g., of corrosion inhibitors, other passivating agent(s), or a suitable combination of the forgoing.

If treated fluid such as SAGD process water containing passivating agent(s) such as those listed in the examples 1-6 described herein are used, the metallic component(s) in question that are exposed to SAGD process water containing a fouling agent are also (continuously, intermittently, or periodically) treated with anti-corrosion agents. Thus, the maintenance dose(s) of treatment help to prevent or slow the fouling process. Corrosion of metallic surfaces, such as heat exchanges, metallic piping, et cetera in a SAGD system may be prevented or reduced or slowed, and in turn the resultant fouling of these same elements may be prevented or reduced or slowed.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

In the specification there has been set forth example embodiments and, although specific terms are used, the description thus given uses terminology in a generic and descriptive sense only and not for purposes of limitation.

Finally, any numerical parameters set forth in the specification and claim(s) are approximations (for example, by using the term "about") that may vary depending upon the desired properties sought to be obtained by the embodiment (s). At the very least, each numerical parameter should at least be construed in light of the number of significant digits and by applying ordinary rounding.

What is claimed is:

1. A method of preventing hydrocarbon fouling of a metallic component used in a steam assisted gravity drainage (SAGD) oil recovery system, the method comprising:

passivating the metallic component for use in the oil recovery system, and contacting the surface of the metallic component with a hydrocarbon-containing process water stream of the SAGD oil recovery system.

2. The method of claim 1, wherein passivating the metallic component comprises promoting the formation of a passivating film on the surface of the metallic component to prevent corrosion.

3. The method of claim 2, wherein the passivating film is formed via contacting the metallic component with a solution including one or more passivating agents.

4. The method of claim 3, wherein the one or more passivating agents are selected from the group consisting of hydroxyethylidene-diphosphonic acid (HEDP), sodium erythorbate, and sodium nitrate.

5. The method of claim 4, wherein the one or more passivating agents comprise about 0.1-10% weight HEDP, about 0.1-1.0% weight sodium erythorbate, and about 0.1-10% weight sodium hydroxide.

6. The method of claim 1, further comprising:

contacting the metallic component with a caustic solution while the oil recovery system is online.

7. The method of claim 6, wherein the caustic solution comprises about 50 mg/l NaOH.

8. The method of claim 1, further comprising:

taking the oil recovery system offline; and contacting the metallic component with a caustic solution following taking the oil recovery system offline.

9. The method of claim 8, wherein the caustic solution includes NaOH.

10. The method of claim 9, wherein the caustic solution includes about 50 mg/l sodium hydroxide.

11. The method of claim 10, further comprising placing the oil recovery system back online.

12. The method of claim 1, wherein the metallic component is a heat exchanger.

13. The method of claim 1, wherein passivating the metallic component comprises contacting the metallic component with one or more passivating agents selected from the group consisting of sodium borate, stannous salts/Tin, tannic acid, tetra potassium pyrophosphate (TKPP), sodium molybdate, potassium hydroxide, sodium hydroxide, hydroxyethylidene-diphosphonic acid (HEDP), sodium erythorbate, diethylhydroxylamine (DEHA), sodium nitrite, and sodium nitrate.

14. The method of claim 13, wherein contacting the metallic component with the one or more passivating agents occurs while the oil recovery system is online.

* * * * *